US005185995A

United States Patent [19]

Dal Monte

[11] Patent Number: 5,185,995

[45] Date of Patent: Feb. 16, 1993

[54] ROPE CHAIN WITH NOVEL LINK

[75] Inventor: Giuseppe A. Dal Monte, West Hollywood, Calif.

[73] Assignee: OroAmerica, Inc., Burbank, Calif.

[21] Appl. No.: 789,858

[22] Filed: Nov. 8, 1991

[51] Int. Cl.[5] ..... B21L 5/02

[52] U.S. Cl. ..... 59/80; 59/3; 59/83

[58] Field of Search ..... 59/1, 3, 16, 20, 25, 59/35.1, 78, 80, 83

[56] References Cited

U.S. PATENT DOCUMENTS

| | | | |
|---|---|---|---|
| 4,651,517 | 3/1987 | Benhamou et al. | 59/16 |
| 4,934,135 | 6/1990 | Rozenwaser | 59/80 |
| 4,996,835 | 3/1991 | Rozenwasser | 59/3 |

OTHER PUBLICATIONS

International Designs Bulletin, DM/014648, "S.I.L.O.", Sep. 26, 1989.

International Designs Bulletin, DM/016267, "Grando", Mar. 27, 1990.

*Primary Examiner*—David Jones

[57] ABSTRACT

Precious metal link wire for forming into individual links members having an outer periphery and an inner periphery. The individual link members are then joined into the jewelry rope chain. The link wires have a majority of their weight of precious metal lying in the outer peripheral volume of the link members. The links made from such link wire save precious metal without requiring a greater number of links to be assembled to form a given unit length of jewelry rope chain having a desired diameter, and jewelry rope chain made from such links have a smooth, tight, and non-corrugated appearance.

12 Claims, 3 Drawing Sheets

Fig 1 (PRIOR ART)
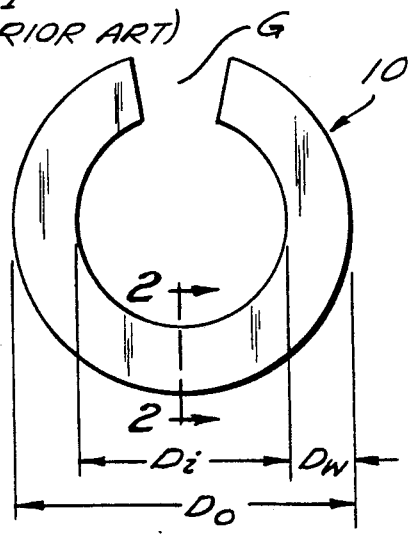
Fig. 5
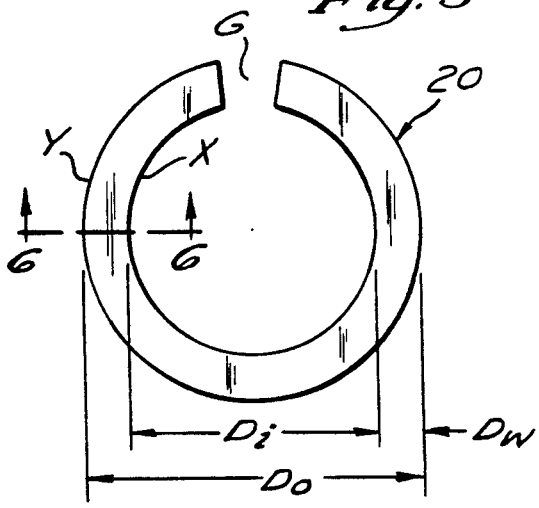
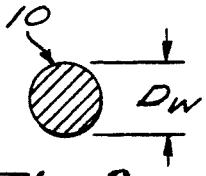
Fig. 2a (PRIOR ART)
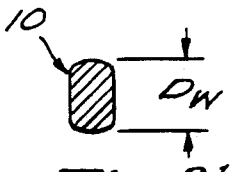
Fig. 2b (PRIOR (ART)
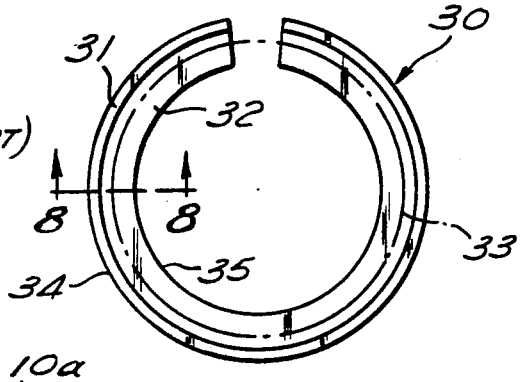
Fig. 7
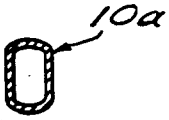
Fig. 3 (PRIOR ART)
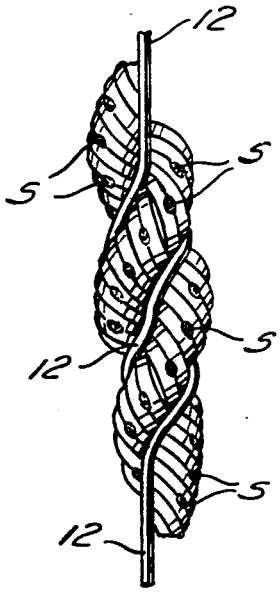
Fig. 4 (PRIOR ART)
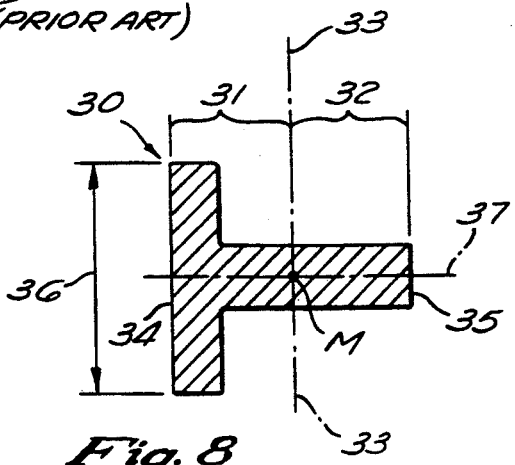
Fig. 8

ROPE CHAIN WITH NOVEL LINK

FIELD OF THE INVENTION

This invention relates to a new design for the wire forming the link members of rope chain.

BACKGROUND OF THE INVENTION

Jewelry rope chain has been known for many decades, both in a hand-made and machine made forms, with machine made forms of these chains generally being limited to less expensive chains, where less precision in the joining of the links of chains is required. However, regardless of the method used to assemble the individual links into the rope chain, the cost of precious metals and their alloys, such as 14 Karat gold and the like used to make the chain is a large component of the final cost of the finished rope chain.

While assembly costs can be decreased by manufacturing rope chain in countries with low labor costs and by introducing labor saving tools and machines, the jewelry manufacturer can do little about the cost of gold, platinum, and other precious metal, which are almost identical around the world. Therefore, there is a strong need for the manufacture of rope chain designs which, while preserving the same look (and also width of chain) as conventional chain designs, in fact, use substantially less precious metal per unit length.

In order to gain a better understanding of the solution to the objective of saving precious metals in making rope chain, it is instructive to review the basics of rope chain manufacture. All rope chains are assembled from a large number of annular link members with gaps. Such a typical link 10 is shown in FIGS. 1–3. Traditionally, these links have been either solid 10 (FIGS. 2*a* or 2*b*) or hollow 10*a* (FIG. 3) and either having a generally rectangular or circular cross-sections FIG. 2*a* or FIG. 2*b*. By arranging series of these rings with their gaps G alternately facing up and down, e.g. as described in Benhamou, et al. U.S. Pat. No. 4,651,517 the rope chain is gradually built up, held in place with a forming wire 12, and soldered at points S to form the rope chain shown in FIG. 4.

In these prior art chains, the individual links 10 are chosen so that the central opening Di in the ring 10 has a diameter slightly greater than three times greater than the widest portion of the link wire Dw, for example, 3.4 times greater. Arranged in this way, four links would make up the basic, repeating, series of links used to form the chain.

U.S. Pat. No. 4,651,517 to Benhamou, et al. discusses the prior art rope chains in great detail, and discloses an improvement over the traditional prior art method in saving precious metal for an equivalent length and width of finished rope chain whereby instead of using a series of four repeating rings arranged as shown in FIGS. 5*a*–5*d* therein, a series of 6, 8 or more even number of links, each having a larger internal diameter compared to the ring cross-sections of the prior art chains are used to save material as shown in FIGS. 8*a*–8*g* therein. Additionally U.S. Pat. No. 4,996,835 to Rozenwasser and S.I.L.O. patent DM014648 illustrate rope chains wherein the links are non-circular in shape, in order to save precious metal.

These prior art rope chains utilize links in which the wire cross-sections thereof are basically circular, or rectangular with rounded corners. Although the shapes of the prior art links achieve the goal of allowing the manufacturer to save precious metal, for a given width and length of chain, their use generally results in increased labor costs since a greater number of links must be assembled to make a rope chain having the same length and width. Moreover, as the number of links per unit length increases, the chains may become more difficult to assemble.

It has also been known in the prior art of making flat chains to use precious metal wire having a triangular cross-section, with one corner of the triangle defining the outermost perimeter of each link member. The applicant himself has previously made rope chains with wire having a triangular cross-section, with one corner of the triangle defining the outermost perimeter of the wire once formed into the individual link members. Although material is saved, rope chains assembled from such wire have a somewhat corrugated appearance and feel sharp to the touch. Thus rope chains made from triangular link wire formed into link members with one corner of the wire defining the outer perimeter of the link members are not as desirable as prior art chains made of "smoother" link wire from the standpoint of appearance and feel of the finished rope chain. There is accordingly a need for rope chain which is formed in a way to save material, but which can be assembled without using a greater number of links per unit length, and which also results in a smooth, tight, and non-corrugated appearance.

SUMMARY OF THE INVENTION

The instant invention achieves the desired goal of both reducing the quantity of precious metal, without increasing the number of links required to assemble a rope chain of a given width (outside diameter) and length, by modifying only the shape of the cross-section of the wire used to form the individual links. The overall geometry of the link shape itself can remain as in the prior art, e.g. circular, as shown in FIG. 1, oval, as shown in Rozenwasser (see FIGS. 11–13, 17*a*–*f* and 20 therein), hexagonal, S.I.L.O. (See FIG. 4 therein), or other non-annular forms of links.

The wire cross-section of the links of this invention is formed so that the weight (or volume) of precious metal material nearest the outer perimeter in the outer peripheral volume, is greater than the weight (or volume) of the precious metal material near the inner perimeter in the inner peripheral volume. The inner peripheral volume of the wire, for definitional purposes, is formed on the interior side of a phantom bisecting surface drawn midway between the outermost perimeter of the wire and the innermost perimeter of the wire. The outer peripheral volume of the wire, for definitional purposes herein, is formed on the exterior side of a phantom bisecting surface drawn midway between the outermost perimeter and the innermost perimeter of the wire.

The cross-sectional configurations of the link wire forming the individual links may have a variety of cross-sections including those depicted in FIGS. 6*a*–6*m*. In order to clearly understand the benefits conferred by this invention, it should be noted that the modifications here to be explained are directed only to modifications in the wire cross-section forming the link, and not to the overall link shape itself. Thus the term "overall link shape", as used herein, refers to the finished link shape with a gap formed therein, as depicted in e.g. FIGS. 1–3, and the term "wire cross-section" or "link wire cross-section" refers to the cross-section of the wire which is later formed into a partially closed finished link member of annular or non-annular configuration having a gap between opposed ends, with the gap being slightly larger than the maximum width of the wire. Typical wire cross-sections of this invention are depicted in FIGS. 6a–6m.

By using link wire having a cross-section shown in FIGS. 6a–6m, the total number of individual links for a given rope chain link assembly can remain unchanged, but the quantity of precious metal will be substantially less than a similarly rope chain assembled from prior art square or circular cross-section link wire. Each of the link wire cross-sections of FIGS. 6a–6m are shown with phantom circles drawn in dotted lines in their backgrounds. Viewing FIG. 5, which is a plan view of one possible overall link shape into which the link wire of this invention can be formed, the outwardly most projecting portion of the link wire Y defines the outermost perimeter of the link and the inwardly most projecting portion X defines the innermost perimeter of the link.

The precious metal material savings realized by using link wires having the cross-sections shown in FIGS. 6a–6m are substantial. For example, for the wire having an "inverted triangle" cross-section, such as that shown in FIG. 6f, the material saving compared to a link made of link wire having a circular wire cross-section of the equivalent girth is approximately 36%. Even greater weight savings are achieved by using link wire having a "T"-shaped cross-section, such as that shown in FIG. 6c, where a 46% weight savings can be attained over a link made of round wire. These figures are even higher when these link wire cross-sections are compared to link wire having a square cross-section. For example, the "inverted" triangle link wire cross-section of FIG. 6f achieves a net weight savings per link of 50% and the "T"-shaped link wire cross-section of FIG. 6c saves approximately 58% material. The calculations for these two shapes are set forth below in the detailed description.

BRIEF DESCRIPTION OF THE FIGURES

FIG. 1 is plan view of an annular link of the prior art;

FIGS. 2a and 2b are cross-sections of two typical prior art solid wires forming the annular link of FIG. 1, each taken along the line 2—2;

FIG. 3 is a cross-section of a prior art hollow wire forming the annular link of FIG. 1;

FIG. 4 is a side elevation showing a section of rope chain of the prior art in the process of being assembled with the forming wire not yet removed;

FIG. 5 is a plan view of one of the possible link shapes into which the link wire of the instant invention can be formed;

FIG. 7 is a plan view of one of the possible link shapes into which the link wire of the present invention can be formed, showing the mid-plane; and FIG. 8 is a cross-sectional view of a "T"-shaped link through 7—7 in FIG. 7.

DETAILED DESCRIPTION OF THE INVENTION

FIGS. 1–4 of the prior art have been described above and need no further discussion.

Figure 6A:
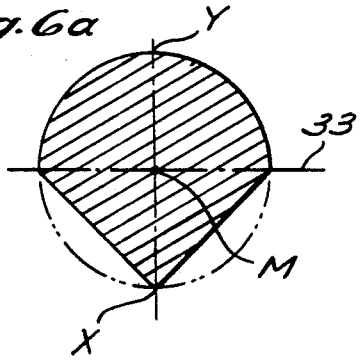
FIGS. 6a–6m show cross-sections of a number of possible embodiments of the link wire of the invention.
Figure 6E:
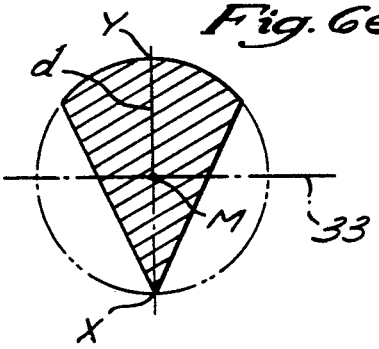
Figure 6B:
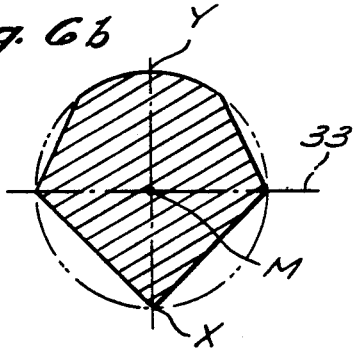
Figure 6F:
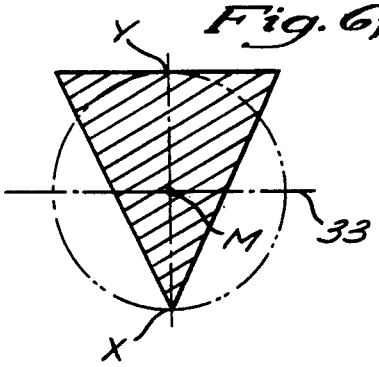
Figure 6C:
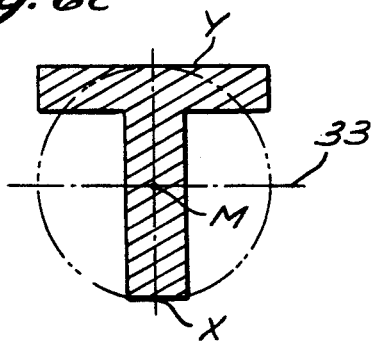
Figure 6G:
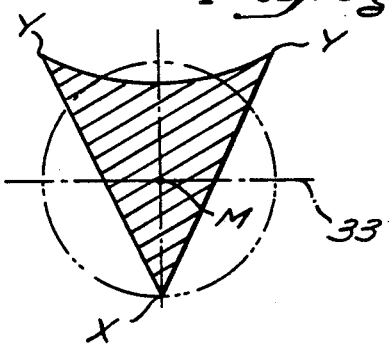
Figure 6D:
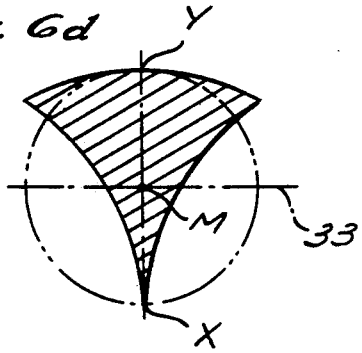
Figure 6H:
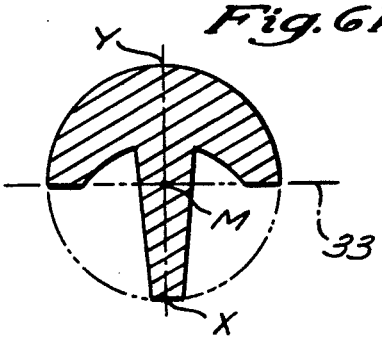
Figure 6I:
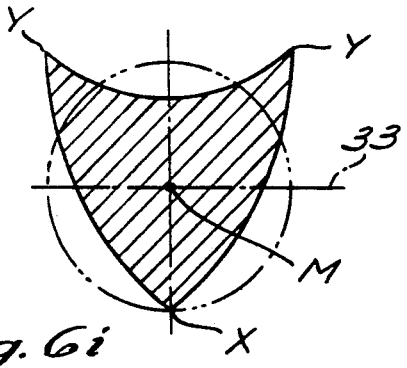
Figure 6M:
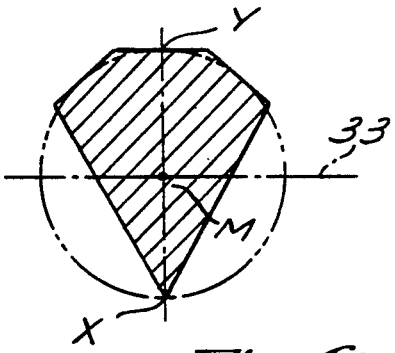
Figure 6J:
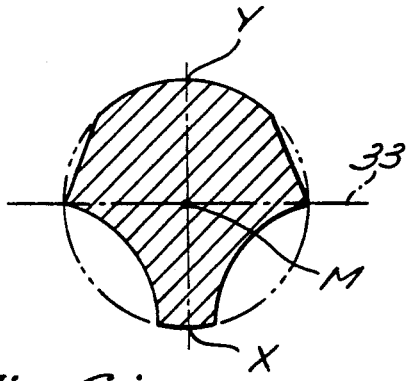
Figure 6K:
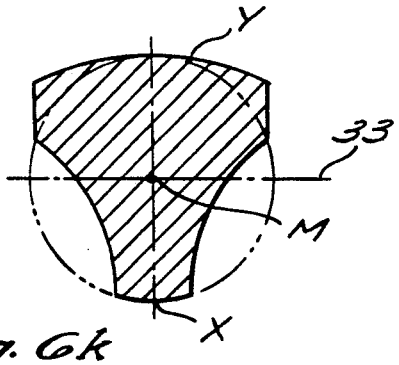
Figure 6L:
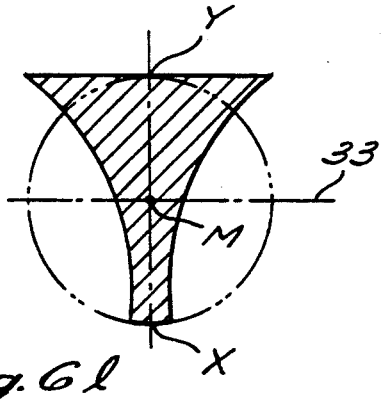

One of the possible overall link shapes into which the link wire of this invention can be formed is shown in FIG. 5 and is designated by the number 20. The ratio of the inner overall link diameter Di to the major wire diameter (Dw, the distance between points X and Y in FIGS. 6a–6m) can be chosen to be 3:1 or greater. Alternately, the link shapes can be made elongate to have a longer major axis and shorter minor axis with the major axis defining the thickness of the rope chain, e.g. as depicted in S.I.L.O. DM 014,648 or Rozenwasser, U.S. Pat. No. 4,996,835.

As is clear from FIGS. 5 and 6a–6m of the invention, the majority of the weight of wire 20 lies within the outer peripheral volume M-Y of the wire, as opposed to the inner peripheral volume M-X of the wire once the wire is formed into the individual link members.

This arrangement is also clearly shown with regards to FIGS. 7 and 8, which are respectively a top plan view of a circular link members, and a cross-sectional view of it showing a wire having a "T"-shaped cross section. (Such as that shown in FIG. 6c). With such an arrangement, the majority of the weight of precious materials of the link member 30 will lie in the outer peripheral volume 31 of the link member and the balance of precious material of the link member will lie in the inner peripheral volume 32 of the link member, the outer and inner peripheral volumes 31 and 32 being separated by a phantom bisecting surface 33 drawn at a point "M" midway between the outermost perimeter 34 ("Y" in FIGS. 5 and 6) and innermost perimeter 35 ("X" in FIGS. 5 and 6) of the link member 30. The thickness of each link member 30 is defined by the maximum width 36 of the link wire along a line perpendicular to the outer periphery 34 and inner periphery 35 of the link wire. The phantom bisecting surface 33 may be circular in its path, as in the case of an annular link member, may follow a hexagonal course, as in the case of a hexagonal link member, or may follow an oval course, as in the case of a oval link member. The cross-section of the link wire usually, but not always, is symmetrical along a plane 37 drawn perpendicular to and drawn bisecting the phantom surface 33 drawn midway between said outer and inner peripheral volumes M-Y and M-X, respectively.

As previously discussed, the amount of precious metal saved by using link wire having cross-sections of the shapes shown in FIGS. 6a–6m will be substantial when compared to links made from round or square link wire. These precious metal savings are all accompanied without the need to use a greater number of links per unit length of finished rope chain. Thus, precious metal can be saved without labor costs being increased.

As an example of the weight savings over the prior art equivalently shaped link elements having a square or circular cross-section, the following examples are set forth:

Comparing the cross-sectional surface area of an "inverted triangle" cross-section wire (shown in FIG. 6f), to a square cross-section wire having sides of length=2d, and a cross-sectional area equal to 2 d·2 d=4 $a^2$, the weight savings are approximately as follows:

$$\begin{aligned}&\text{cross-sectional area of "inverted triangle"}\\ &= \tfrac{1}{2}(\text{base} \cdot \text{height})\\ &= \tfrac{1}{2}(2d \cdot 2d)\\ &= 2d^2\end{aligned}$$

$$\text{weight savings} = 1 - \frac{\text{surface area of inverted triangle}}{\text{surface area of square}} =$$

-continued $$1 - \frac{2d^2}{4d^2} = 50\%$$

Comparing the cross-sectional surface area of the "inverted triangle" to the surface area of a circle with a radius = 1d, the savings are also substantial:

$$\text{cross-sectional area of circle} = \pi \cdot r^2 = 3.1416 \cdot r^2$$

weight savings =

$$1 - \frac{\text{surface area of inverted triangle}}{\text{surface area of circle}} = \frac{2d^2}{3.1416d^2} = 36\%$$

For a T-shaped cross-section (FIG. 6c) where the top of the "T" is 2d wide and 0.4d thick and the bottom arm of the "T" is 1.6d long and 0.55d wide, the weight savings are even greater:

$$\text{cross-sectional area of "}T\text{"} = (2d \cdot 0.4d) + (1.6d \cdot 0.55d) = 0.8d^2 + .88d^2 = 1.68d^2$$

$$\text{weight saving compared to a square cross-section} = 1 - \frac{\text{"}T\text{"}}{\text{square}} = 1 - \frac{1.68d^2}{4d^2} = 1 - 0.42 = 58\%$$

$$\text{weight saved compared to a circular cross-section} = 1 - \frac{\text{"}T\text{"}}{\text{circle}} = 1 - \frac{1.69d^2}{3.1416d^2} = 1 - 0.53 = 46\%$$

A further benefit is that unlike the prior art hollow wire, (which link wire is difficult and costly to produce) the various link wires of the cross-sections shown herein are easily manufactured and the links made from these solid link wires are easily assembled.

The outer diameter or width of a rope chain is determined by the widest portion of the link Do which straddles the gap G in the overall link member 10. (See FIG. 5). The inner diameter Di of the link member 10 determines the ratio of the major wire diameter Dw to the inner diameter Di of the overall link member 10. In addition to the ease of forming link wire having a circular cross-section or a rectangular cross-section with rounded corners, links made from such wire members, give the finished rope chain a smooth, tight, and non-corrugated appearance.

The inventor has found by using link member of link wire cross-section with the majority of the weight of precious material lying in the outer peripheral volume of the link member, the finished rope chain of the instant invention will have a smooth, tight, and non-corrugated appearance much as the prior art rope chains, yet using far less precious material. This goal is achieved since the desired ratio of major wire diameter Dw to link member inner diameter Di is unchanged, and thus the number of link members per unit length of chain is not increased, all while the weight of precious metal per link is decreased.

The drawings and the foregoing description are not intended to represent the only form of the invention in regard to the details of its construction and manner of operation. In fact, it will be evident to one skilled in the art that modifications and variations may be made without departing from the spirit and scope of the invention. Changes in form and in the proportion of the wire cross-section are contemplated as circumstances may suggest or render expedient; and although specific terms have been employed, they are intended in a generic and descriptive sense only and not for the purpose of limitation, the scope of the invention being delineated in the following claims:

I claim:

1. In a jewelry rope chain, having a plurality or tightly interfitting link members made from link wire, each of said link members being formed into partially closed members having a gap between opposed ends thereof which gap is slightly larger than the maximum width of said link wire to permit insertion of one link member into and through the gap of any other link member, the improvement which comprises:

each of said link members having an outer peripheral volume and an inner peripheral volume, the boundary between said outer and inner peripheral volumes being defined by a phantom bisecting surface drawn midway between an outermost perimeter and an innermost perimeter of each of said link members, said link wire having a majority of its weight lying within said outer peripheral volume of said link member and a balance of its weight lying within said inner peripheral volume of said link member.

2. The jewelry rope chain of claim 1, wherein said link wire has a generally triangular cross-section, oriented such that a base of the triangular cross-section of each link member lies on the outer perimeter of said link members formed into the rope chain.

3. The jewelry rope chain of claim 1, wherein said link wire has a generally "T"-shaped cross-section with a top portion of the "T"-shaped cross-section of each link member oriented to lie on the outer perimeter of said link members formed into the rope chain.

4. The jewelry rope chain of claim 1, wherein said base of said triangular cross-section lying on the outer perimeter of said link members is convexly formed.

5. The jewelry rope chain of claim 1, wherein said base of said triangular cross-section lying on the outer perimeter of said link members if concavely formed.

6. The jewelry rope chain of claim 1, wherein said base of said triangular cross-section lying on the outer perimeter of said link members is convexly curved and two remaining sides of the triangular cross-section are concavely curved.

7. The jewelry rope chain of claim 1, wherein said link wire has a generally triangular cross-section with corners of said base of said triangle cross-section cut off.

8. The jewelry rope chain of claim 1, wherein said link wire has a generally chevron-shaped cross-section, with a wider portion of said link wire cross-section lying adjacent said outer perimeter.

9. The jewelry rope chain of claim 1, wherein said link wire is symmetrical along a phantom plane perpendicular to and traversing said bisecting surface drawn midway between said outer and inner perimeters of said link members.

10. The jewelry rope chain of claim 1, wherein said link wire is solid.

11. A jewelry rope chain having a plurality of tightly interfitting partially closed link members made from link wire made of a material, each of said link members being formed from link wire which is formed into said partially closed link members with a gap between opposed ends of said link wire, said link members having an inner perimeter, an outer perimeter and a phantom bisecting surface bisecting said link wire of said link member midway between said inner and said outer perimeter, said link wire having a cross-sectional shape such that a majority of weight of said material of said links wire lies between said outer perimeter and said bisecting surface and a balance of its weight lies between said inner perimeter and said phantom bisecting surface.

12. A jewelry rope chain having a plurality of tightly interfitting partially closed link members made from link wire made of a material, each of said link members being formed from link wire which is formed into said partially closed link members with a gap between opposed ends of said link wire, said link members having an inner perimeter, an outer perimeter, and a phantom bisecting surface bisecting said link wire of said link member between said inner and outer perimeters, said link wire having a generally triangular cross-sectional shape, oriented such that a base of the triangular cross-section of said wire lies on said outer perimeter of said link members, a majority of weight of said material of said link wire thereby lying between said outer perimeter and said phantom bisecting surface and a balance of its weight lying between said inner perimeter and said phantom bisecting surface.

* * * * *

US005185995B1

REEXAMINATION CERTIFICATE (2846th)

United States Patent [19] [11] B1 5,185,995

Dal Monte [45] Certificate Issued Apr. 16, 1996

[54] ROPE CHAIN WITH NOVEL LINK

[75] Inventor: Giuseppe A. Dal Monte, West Hollywood, Calif.

[73] Assignee: OroAmerica, Inc., Burbank, Calif.

Reexamination Request:
No. 90/003,341, Feb. 22, 1994

Reexamination Certificate for:

| | |
|---|---|
| Patent No.: | **5,185,995** |
| Issued: | **Feb. 16, 1993** |
| Appl. No.: | **789,858** |
| Filed: | **Nov. 8, 1991** |

[51] Int. Cl.[6] ..... B21L 5/02
[52] U.S. Cl. ..... 59/80; 59/3; 59/83
[58] Field of Search ..... 59/80, 3, 83, 78, 59/35.1

[56] References Cited

U.S. PATENT DOCUMENTS

| | | |
|---|---|---|
| 407,723 | 7/1889 | Crook . |
| 1,196,010 | 8/1916 | Merritt . |
| 4,651,517 | 3/1987 | Benhamou et al. . |
| 4,716,750 | 1/1988 | Tizzi . |
| 4,934,135 | 6/1990 | Rozenwasser . |
| 4,996,835 | 3/1991 | Rozenwasser . |
| 5,129,220 | 7/1992 | Strobel . |
| 5,185,995 | 2/1993 | Dal Monte . |

FOREIGN PATENT DOCUMENTS 17408 of 1902 United Kingdom .

OTHER PUBLICATIONS

"The Technique of Jewellery", R. Edwards, pp. 98–103, The Anchor Press Ltd., 1977.

*Primary Examiner*—David B. Jones

[57] ABSTRACT

Precious metal link wire for forming into individual links members having an outer periphery and an inner periphery. The individual link members are then joined into the jewelry rope chain. The link wires have a majority of their weight of precious metal lying in the outer peripheral volume of the link members. The links made from such link wire save precious metal without requiring a greater number of links to be assembled to form a given unit length of jewelry rope chain having a desired diameter, and jewelry rope chain made from such links have a smooth, tight, and non-corrugated appearance.

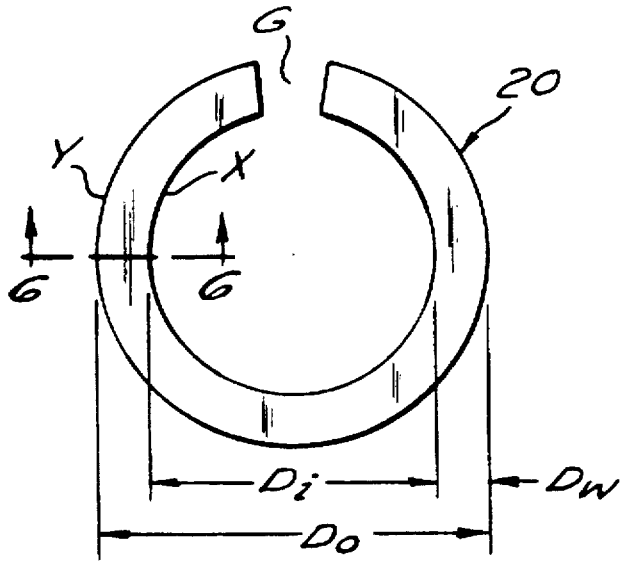

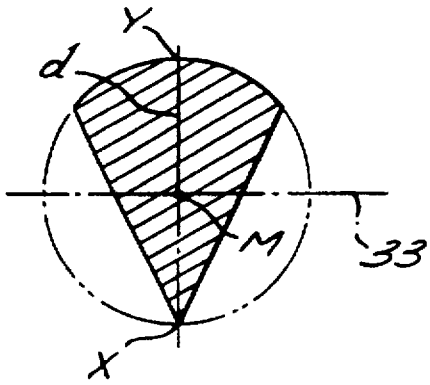

REEXAMINATION CERTIFICATE ISSUED UNDER 35 U.S.C. 307

THE PATENT IS HEREBY AMENDED AS INDICATED BELOW.

Matter printed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 12 is confirmed.

Claims 2–10 are cancelled.

Claims 1 and 11 are determined to be patentable as amended.

New claims 13–32 are added and determined to be patentable.

1. In a jewelry rope chain, having a plurality [or] *of* tightly interfitting link members [made from], *each link member being formed from a single, solid* link wire, *and* each of said link members being formed into partially closed members having a gap between opposed ends thereof which gap is slightly larger than the maximum width of said link wire to permit insertion of one link member into and through the gap of any other link member, the improvement which comprises:

each of said link members having an outer peripheral volume and an inner peripheral volume, the boundary between said outer and inner peripheral volumes being defined by a phantom bisecting surface drawn midway between an outermost perimeter and an innermost perimeter of each of said link members, said link wire having a majority of its weight lying within said outer peripheral volume of said link member and a balance of its weight lying within said inner peripheral volume of said link member, *wherein in cross-section, said link wire has a larger surface area lying within an outer periphery and a smaller surface area lying within an inner periphery.*

11. A jewelry rope chain having a plurality of tightly interfitting partially closed link members, *each link member being* made from *a single, solid* link wire [made of a material], *and* each of said link members being formed [from link wire which is formed] into said partially closed link members with a gap between opposed ends of said link wire, said link members having an inner perimeter, an outer perimeter and a phantom bisecting surface bisecting said link wire of said link member midway between said inner and said outer perimeter, said link wire having a cross-sectional shape such that a majority of weight of said material of said link wire lies between said outer perimeter and said bisecting surface and a balance of its weight lies between said inner perimeter and said phantom bisecting surface, *and wherein in cross-section, said link wire has a larger surface area lying between said outer perimeter and said bisecting surface and a small surface area lying between said inner perimeter and said phantom bisecting surface.*

*13. In a jewelry rope chain, having a plurality of tightly interfitting link members, each of said link members being formed from a single link wire, and each of said link members being formed into partially closed members having a gap between opposed ends thereof which gap is slightly larger than the maximum width of said link wire to permit insertion of one link member into and through the gap of any other link member, the improvement which comprises:*

*each of said link members having an outer peripheral volume and an inner peripheral volume, the boundary between said outer and inner peripheral volumes being defined by a phantom bisecting surface drawn midway between an outermost perimeter and an innermost perimeter of each of said link members, said link wire having a majority of its weight lying within said outer peripheral volume of said link member and a balance of its weight lying within said inner peripheral volume of said link member, wherein said link wire has a generally triangular cross-section, oriented such that a base of the triangular cross-section of each link member lies on the outer perimeter of said link members formed into the rope chain.*

*14. In a jewelry rope chain, having a plurality of tightly interfitting link members each of said link members being formed from a single link wire, and each of said link members being formed into partially closed members having a gap between opposed ends thereof which gap is slightly larger than the maximum width of said link wire to permit insertion of one link member into and through the gap of any other link member, the improvement which comprises:*

*each of said link members having an outer peripheral volume and an inner peripheral volume, the boundary between said outer and inner peripheral volumes being defined by a phantom bisecting surface drawn midway between an outermost perimeter and an innermost perimeter of each of said link members, said link wire having a majority of its weight lying within said outer peripheral volume of said link member and a balance of its weight lying within said inner peripheral volume of said link member, wherein said link wire has a generally "T"-shaped cross-section with a top portion of the "T"-shaped cross-section of each link member oriented to lie on the outer perimeter of said link members formed into the rope chain.*

*15. The jewelry rope chain of claim 13, wherein said base of said triangular cross-section lying on the outer perimeter of said link members is convexly formed.*

*16. The jewelry rope chain of claim 13, wherein said base of said triangular cross-section lying on the outer perimeter of said link members is concavely formed.*

*17. The jewelry rope chain of claim 13, wherein said base of said triangular cross-section lying on the outer perimeter of said link members is convexly curved and two remaining sides of the triangular cross-section are concavely curved.*

*18. In a jewelry rope chain, having a plurality of tightly interfitting link members each of said link members being formed from a single link wire, and each of said link members being formed into partially closed members having a gap between opposed ends thereof which gap is slightly larger than the maximum width of said link wire to permit insertion of one link member into and through the gap of any other link member, the improvement which comprises:*

*each of said link members having an outer peripheral volume and an inner peripheral volume, the boundary between said outer and inner peripheral volumes being defined by a phantom bisecting surface drawn midway between an outermost perimeter and an innermost perimeter of each of said link members, said link wire having a majority of its weight lying within said outer*

*peripheral volume of said link member and a balance of its weight lying within said inner peripheral volume of said link member, wherein said wire has a generally triangular cross-section with corners of said base of said triangle cross-section cut off.*

*19. In a jewelry rope chain, having a pluraliity of tightly interfitting link members each of said link members being formed from a single link wire, and each of said link members being formed into partially closed members having a gap between opposed ends thereof which gap is slightly larger than the maximum width of said link wire to permit insertion of one link member into and through the gap of any other link member, the improvement which comprises:*

*each of said link members having an outer peripheral volume and an inner peripheral volume, the boundary between said outer and inner peripheral volumes being defined by a phantom bisecting surface drawn midway between an outermost perimeter and an innermost perimeter of each of said link members, said link wire having a majority of its weight lying within said outer peripheral volume of said link member and a balance of its weight lying within said inner peripheral volume of said link member, wherein said link wire has a generally chevron-shaped cross-section, with a wider portion of said link wire cross-section lying adjacent said outer perimeter.*

*20. In a jewelry rope chain, having a plurality of tightly interfitting link members each of said link members being formed from a single, solid link wire, and each of said link members being formed into partially closed members having a gap between opposed ends thereof which gap is slightly larger than the maximum width of said single, solid link wire to permit insertion of one link member into and through the gap of any other link member, the improvement which comprises:*

*each of said link members having an outer peripheral volume and an inner peripheral volume, the boundary between said outer and inner peripheral volumes being defined by a phantom bisecting surface drawn midway between an outermost perimeter and an innermost perimeter of each of said link members, said single, solid link wire having a majority of its weight lying within said outer peripheral volume of said link member and a balance of its weight lying within said inner peripheral volume of said link member, wherein said link is symmetrical along a phantom plane perpendicular to and traversing said bisecting surface drawn midway between said outer and inner perimeters of said link members.*

*21. In a jewelry rope chain, having a plurality of tightly interfitting link members made from single link wires, each of said link members being formed into partially closed members having a gap between opposed ends thereof to permit insertion of one link member into and through the gap of any other link member, the improvement which comprises:*

*each of said single link members having an outer peripheral volume and an inner peripheral volume, the boundary between said outer and said inner peripheral volumes being defined by a phantom bisecting surface drawn midway between an outermost perimeter and an innermost perimeter of each of said link members, said link wire from which said link members are made having a majority of its weight lying within said outer peripheral volume, and a balance of its weight lying within said inner peripheral volume, wherein a maximum width of said link wire lies within said outer peripheral volume only.*

*22. A jewelry rope chain having a plurality of tightly interfitting partially closed link members made from single, solid link wires made of a material, each of said link members being formed from a single link wire which is formed into said partially closed link members with a gap between opposed ends of said single link wire, said link members having an inner perimeter, an outer perimeter and a phantom bisecting surface bisecting said link wire of said link member midway between said inner and said outer perimeter into inner and outer peripheral regions, said single link wire from which said link members are made having a majority of its weight lying within said outer peripheral region and a balance of its weight lying within said inner peripheral region, said single link wire having a cross-sectional shape such that it has a maximum width lying within said outer peripheral region.*

*23. The jewelry rope chain of claim 21 wherein said single link wire has a minimum width lying within said inner peripheral volume.*

*24. The jewelry rope chain of claim 22 wherein said single link wire has a minimum width lying within said inner peripheral region.*

*25. The jewelry rope chain of claim 21, wherein the weight of a chain formed from said single link members is substantially lighter in weight than a chain formed from solid link members, circular in cross-section, and having a cross-sectional diameter equal to the maximum width of said single link wire.*

*26. The jewelry rope chain of claim 22, wherein the weight of a chain formed from said single, solid link members is substantially lighter in weight than a chain formed from single, solid link members, circular in cross-section, and having a cross-sectional diameter equal to the maximum width of said link wire.*

*27. The jewelry rope chain of claim 21, wherein the single link wire is hollow.*

*28. The jewelry rope chain of claim 22, wherein the single link wire is hollow.*

*29. The jewelry rope chain of claim 21, wherein the single link wire is solid.*

*30. The jewelry rope chain of claim 22, wherein the single link wire is solid.*

*31. The jewelry rope chain of claim 25, wherein the savings in weight is at least 36 percent compared to rope chain made with links formed from solid, circular wire.*

*32. The jewelry rope chain of claim 26, wherein the savings in weight is at least 36 percent compared to rope chain made with links formed from solid, circular wire.*

* * * * *